US009852707B2

(12) United States Patent
Shin et al.

(10) Patent No.: US 9,852,707 B2
(45) Date of Patent: Dec. 26, 2017

(54) DISPLAY APPARATUS

(71) Applicant: Samsung Display Co., Ltd., Yongin (KR)

(72) Inventors: Seung-Woon Shin, Asan-si (KR); Jae-Kook Kim, Asan-si (KR); JeongJin Park, Cheonan-si (KR); Choongseob Oh, Yongin-si (KR); Hyoungbin Lim, Asan-si (KR); Yong-Ju Jeong, Seoul (KR); Minsung Choi, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 286 days.

(21) Appl. No.: 14/517,036

(22) Filed: Oct. 17, 2014

(65) Prior Publication Data

US 2015/0221275 A1 Aug. 6, 2015

(30) Foreign Application Priority Data

Feb. 3, 2014 (KR) ..... 10-2014-0012179

(51) Int. Cl.
*G09G 3/36* (2006.01)

(52) U.S. Cl.
CPC ..... *G09G 3/3677* (2013.01); *G09G 3/3648* (2013.01); *G09G 2310/0286* (2013.01); *G09G 2310/08* (2013.01); *G09G 2320/0219* (2013.01)

(58) Field of Classification Search
CPC ..... G09G 3/3677; G09G 3/3648; G09G 2310/0286; G09G 2310/08; G09G 2320/0219
See application file for complete search history.

(56) References Cited

U.S. PATENT DOCUMENTS

| | | | | |
|---|---|---|---|---|
| 8,044,914 | B2 | 10/2011 | Lee et al. | |
| 8,373,729 | B2 | 2/2013 | Lee et al. | |
| 2008/0198122 | A1* | 8/2008 | Shin | G09G 3/3648 345/94 |
| 2011/0221713 | A1* | 9/2011 | Omoto | G09G 3/3266 345/204 |
| 2015/0279333 | A1* | 10/2015 | Saitoh | G09G 3/20 345/213 |

FOREIGN PATENT DOCUMENTS

| | | |
|---|---|---|
| KR | 10-2007-0014561 | 2/2007 |
| KR | 10-0853212 | 8/2008 |
| KR | 10-2010-0063170 | 6/2010 |
| KR | 10-2010-0102934 | 9/2010 |

* cited by examiner

*Primary Examiner* — Tony N Ngo
(74) *Attorney, Agent, or Firm* — H.C. Parks & Associates, PLC

(57) ABSTRACT

A display apparatus including: gate lines extending in a first direction; data lines extending in a second direction intersecting the first direction; pixels connected to corresponding ones of the gate lines and data lines; a gate driver to drive the gate lines in response to a gate clock signal; a data driver to drive the data lines; a memory to store charge share signals corresponding to the gate lines; a timing controller controlling the data driver and the gate driver, in response to an externally input control signal and an image signal, and to output a gate pulse signal to the gate lines; and a clock generator configured to generate the gate clock signal in response to the gate pulse signal. The timing controller is configured to output the gate pulse signals according to the charge share signals.

7 Claims, 11 Drawing Sheets

DISPLAY APPARATUS

CROSS-REFERENCE TO RELATED APPLICATION

This U.S. non-provisional patent application claims priority from and the benefit of Korean Patent Application No. 10-2014-0012179, filed on Feb. 3, 2014, which is hereby incorporated by reference for all purposes as if fully set forth herein.

BACKGROUND

Field

The present disclosure relates to a display apparatus.

Discussion of the Background

Typically, a display apparatus includes a display panel displaying an image, and a data driver and a gate driver. The display panel includes a plurality of data lines and a plurality of pixels. The data driver outputs a data driving signal to the plurality of data lines, and the gate driver outputs a gate driving signal to the plurality of gate lines.

Such a display apparatus may display an image by applying a gate-on voltage to a gate electrode of a switching transistor connected to a gate line and applying a data voltage to a source electrode corresponding to a display image. As the switching transistor is turned on, a data voltage is applied to a liquid crystal capacitor and a storage capacitor for a predetermined time after the switching transistor is turned off. However, due to a parasitic capacitance existing between the gate and drain electrodes of the switching transistor, distortion may occur in an actual grayscale voltage applied to the liquid crystal capacitor and the storage capacitor. That is, there may be a discrepancy between a grayscale voltage output from the data driver and an actual grayscale voltage applied between the liquid crystal capacitor and the storage capacitor. Such a distorted voltage is referred to as a kickback voltage. As the kickback voltage increases, and as the discrepancies in kickback voltages between the switching transistors increases, the quality of an image displayed on the display panel may be reduced.

Recently, display panels have become larger and a high speed driving scheme is employed, deviations between the kickback voltages according to a pixel position become larger. Accordingly, image quality may not be uniform, since a charging ratio of the liquid crystal capacitor may become different according to the different kickback voltages.

The above information disclosed in this Background section is only for enhancement of understanding of the background of the invention and therefore it may contain information that does not form any part of the prior art nor what the prior art may suggest to a person of ordinary skill in the art.

SUMMARY

Exemplary embodiments of the present disclosure provide a display apparatus having improved image quality.

Additional features of the invention will be set forth in the description which follows, and in part will be apparent from the description, or may be learned by practice of the invention.

Embodiments of the inventive concept provide a display apparatus, including: gate lines extending in a first direction; data lines extending in a second direction intersecting the first direction; pixels respectively connected to corresponding one of the gate lines and data lines; a gate driver driving the gate lines in response to a gate clock signal; a data driver driving the data lines; a memory storing charge share signals; a timing controller controlling the data driver and the gate driver in response to an externally input control signal and an image signal, and to generate a gate pulse signal comprising gate pulses; and a clock generator configured to generate the gate clock signal in response to the gate pulse signal, wherein the timing controller is configured to output the gate pulse signal to corresponding ones of the gate lines, in response to the charge share signal.

In even further embodiments, the gate driver may include a plurality of stages respectively corresponding to the plurality of gate lines and the plurality of stages drive corresponding gate line in response to the gate clock signal and the start pulse signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Exemplary embodiments of the inventive concept will be described below in more detail with reference to the accompanying drawings. The inventive concept may, however, be embodied in different forms and should not be construed as limited to the embodiments set forth herein. Rather, these embodiments are provided so that this disclosure will be thorough and complete, and will fully convey the scope of the inventive concept to those skilled in the art.

It will be understood that when an element or layer is referred to as being "on" or "connected to" another element or layer, it can be directly on or directly connected to the other element or layer, or intervening elements or layers may be present. In contrast, when an element or layer is referred to as being "directly on" or "directly connected to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

Hereinafter, exemplary embodiments of the inventive concept will be described in detail with reference to the accompanying drawings.

Figure 1:
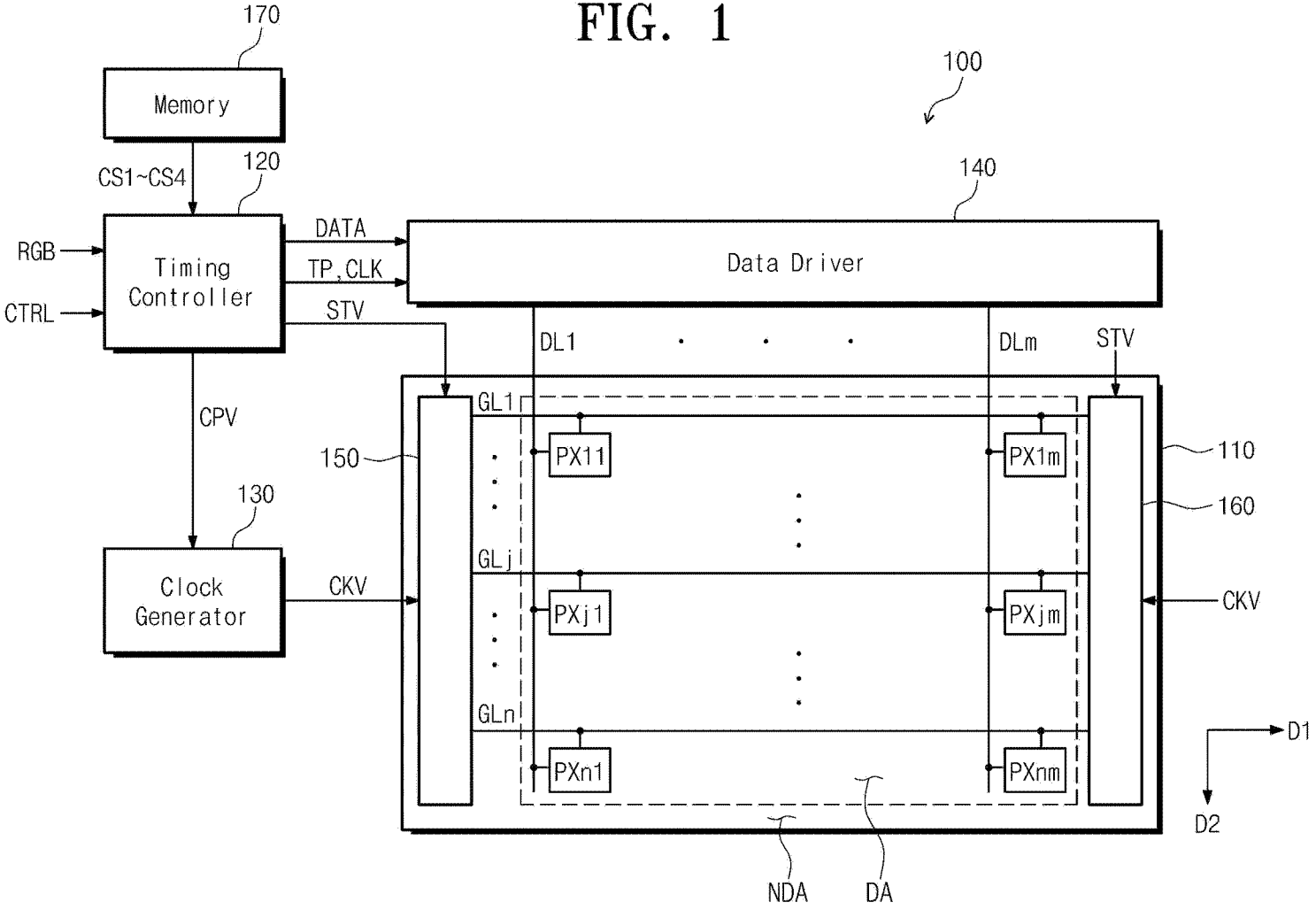
FIG. 1 is a circuit configuration of a display apparatus according to an embodiment of the inventive concept.

FIG. 1 illustrates a circuit configuration of a display apparatus according to an embodiment of the inventive concept.

Referring to FIG. 1, a display apparatus 100 includes a display panel 110, a timing controller 120, a clock generator 130, a data driver 140, first and second gate drivers 150 and 160, and a memory 170.

The display panel 110 includes a plurality of gate lines GL1 to GLn extended in a first direction D1, a plurality of date lines DL1 to DLm extended in a second direction D2, and a plurality of pixels PX11 to PXnm arrayed in a matrix at intersections of the plurality of gate lines GL1 to GLn and the plurality of data lines DL1 to DLm.

Although not shown in the drawing, each of the plurality of pixels PX11 to PXnm includes a switching transistor connected to a corresponding data line and gate line and a crystal capacitor and storage capacitor connected thereto.

The timing controller 120 receives externally an image signal RGB and control signals CTRL for controlling display of the image signal RGB, including a vertical sync signal, a horizontal sync signal, a main clock signal, and a data enable signal. The timing controller 120 provides a data signal DATA, a line latch signal TP, and a clock signal CLK, which are processed under operating conditions of the display panel 110, based on the control signals CTRL to the data driver 140. The timing controller 120 provides a start pulse signal STV to the first and second gate drivers 150 and 160. In addition, the timing controller 120 generates a gate pulse signal CPV, in response to the control signals CRTL, and charge sharing signals CS1 to CS4 that are stored in the memory 170.

The memory 170 stores the charge sharing signals CS1 to CS4. The memory 170 may include an electrically erased programmable ROM (EEPROM). The memory 170 may be integrated into a single chip together with the timing controller 120. The memory 170 stores the charge sharing signals CS1 to CS4.

The data driver 140 outputs grayscale voltages for driving the data lines DL1 to DLm, according to the data signal DATA, the line latch signal TP, and the clock signal CLK.

The clock generator 130 outputs the gate clock signal CKV in response to the gate pulse signal CPV from the timing controller 120.

The first gate driver 150 drives the gate lines GL1 to GLn in response to the start pulse signal STV from the timing controller 120 and the gate clock signal CKV from the clock generator 130. The second gate driver 160 also drives the gate lines GL1 to GLn in response to the start pulse signal STV from the timing controller 120 and the gate clock signal CKV from the clock generator 130.

The first and second gate drivers 150 and 160 may be implemented as a circuit including an amorphous silicon thin film transistor and/or an oxide semiconductor transistor. The first and second gate drivers 150 and 160 are formed on the same substrate as the display panel 110. The first gate driver 150 is disposed adjacent to a first shorter side of the display panel 110, and the second gate driver 160 is disposed adjacent to a second shorter side of the display panel 110.

When a gate-on voltage is applied to one gate line, a row of switching transistors connected thereto is turned on, and the date driver 140 provides grayscale voltages corresponding to the data signal DATA to the data lines DL1 to DLm. The grayscale voltages provided to the data lines DL1 to DLm are applied to corresponding pixels through the turned-on switching transistors. One period of the gate clock signal CKV, which may be defined as a time period that a row of switching transistors is turned on, is referred to as 'one horizontal period' or '1H'. According to exemplary embodiments of the present invention, a kickback voltage, which is a difference between a grayscale voltage output from the data driver 140 and an actual grayscale voltage applied to a pixel, may be compensated by adjusting the one horizontal period 1H.

Figure 2:
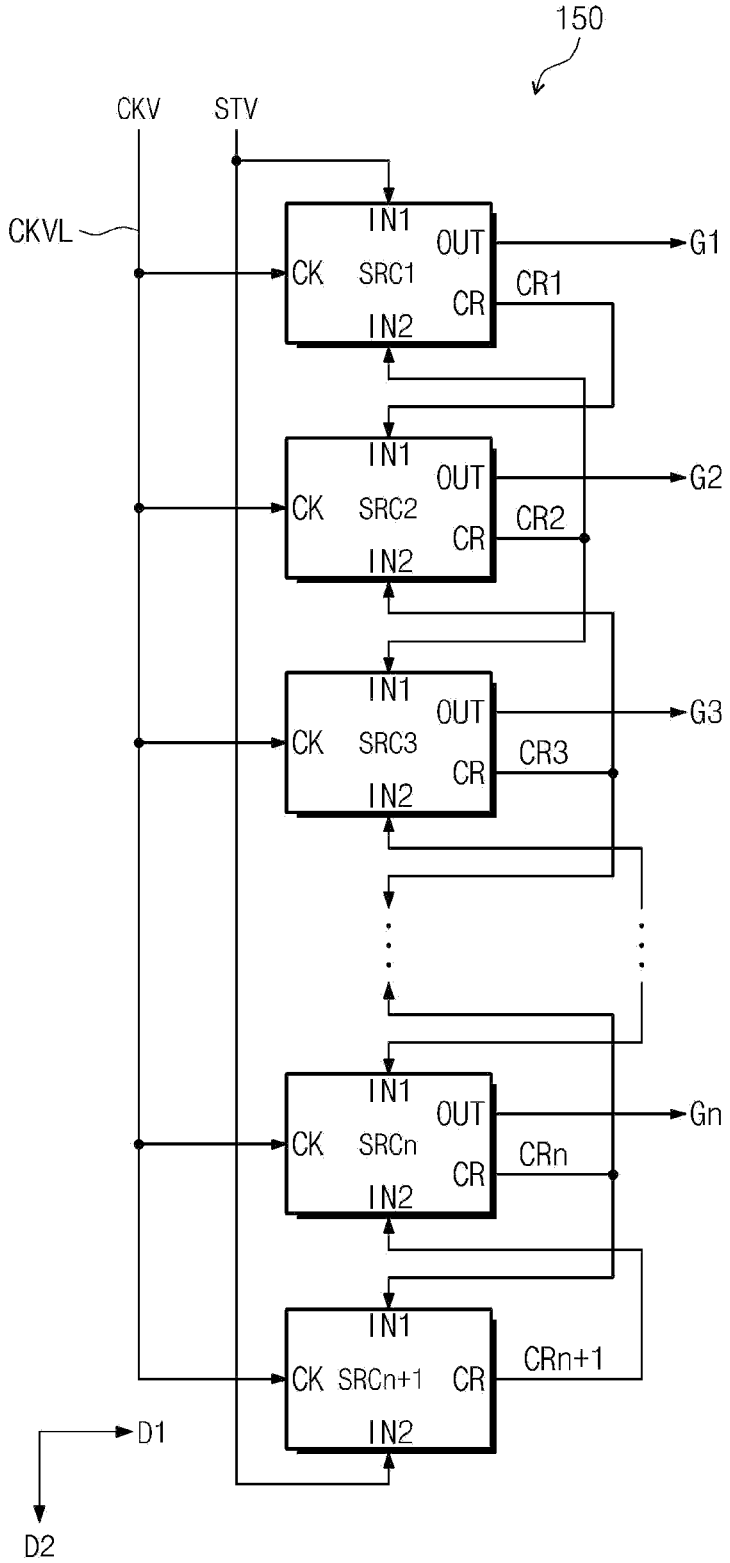
FIG. 2 illustrates a configuration of a first gate driver illustrated in FIG. 1.

FIG. 2 illustrates a configuration of the first gate driver illustrated in FIG. 1.

Referring to FIG. 2, the first gate driver 150 includes a plurality of stages SRC1 to SRCn and a dummy stage SRCn+1. The plurality of stages SRC1 to SRCn respectively correspond to the gate lines GL1 to GLn (shown in FIG. 1). A first stage SRC1 receives the start pulse signal STV, the gate clock signal CKV, and a carry signal CR2 from a second stage SRC2 and outputs a carry signal CR1 and a gate signal G1.

Each stage SRCi (where, i=2, 3, 4, 5, . . . , n) respectively receives a carry signal CRi−1 from a previous stage SRCi−1, the gate clock signal CKV, and a carry signal CRi+1 from a next stage SRCi+1 and outputs a carry signal CRi and a gate signal Gi.

The dummy stage SRCn+1 receives a carry signal CRn, the gate clock signal CKV, and the start pulse signal STV, and outputs a carry signal CRn+1.

As shown in FIG. 2, the first gate driver 150 includes n stages SRC1 to SRCn. The n+1 stages SRC1 to SRCn+1 are sequentially arrayed in the second direction D2, and a signal interconnection CKVL is extended in the second direction D2 and delivers the gate clock signal CKV to the n+1 stages SRC1 to SRCn+1. As the size of the display panel 110 (in FIG. 1) becomes larger, the number of stages SRC1 to SRCn becomes greater. For example, an n-th stage SRCn receives a previous stage carry signal CRn−1, the gate clock signal CKV, and the start pulse signal STV. The previous stage carry signal CRn−1 is a signal generated through the previous stages SCR1 to SCRn−1. Therefore, due to resistance and capacitance components in the previous stages SCR1 to SCRn−1, a falling time of a gate signal provided to a gate line positioned at a bottom end in the second direction D2 of the display panel 110 (in FIG. 1) increases. The second gate driver 160 illustrated in FIG. 1 has the same configuration as the first gate driver 150, and a detailed description thereof is omitted.

Figure 3:
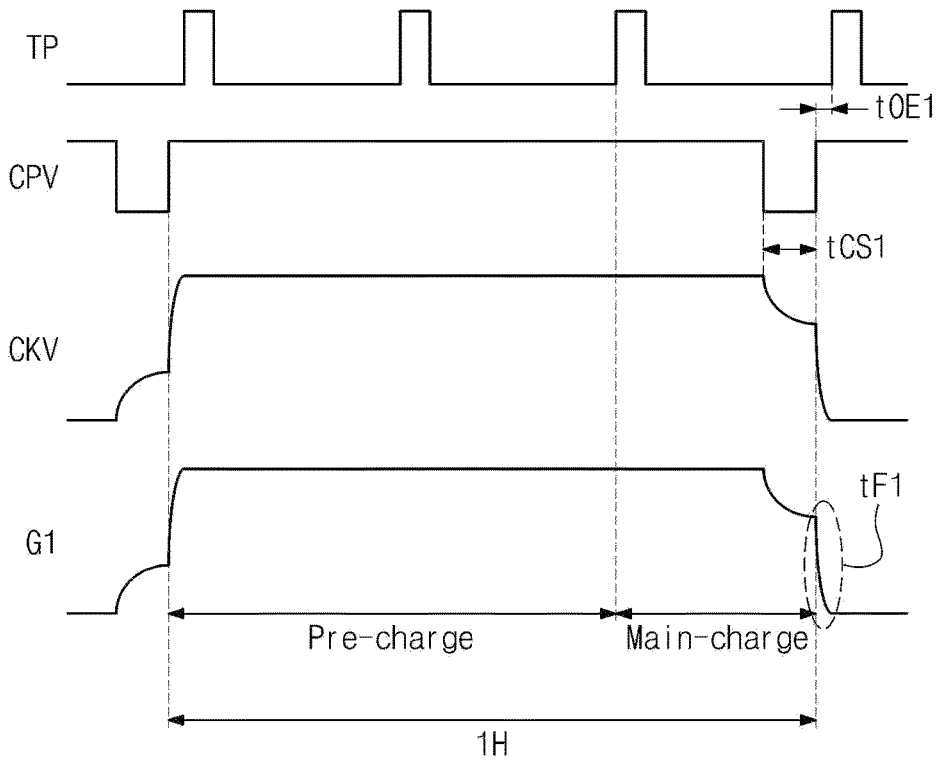
FIGS. 3, 4, and 5 illustrate falling time changes of gate signals provided to the gate lines illustrated in FIG. 1.
Figure 4:
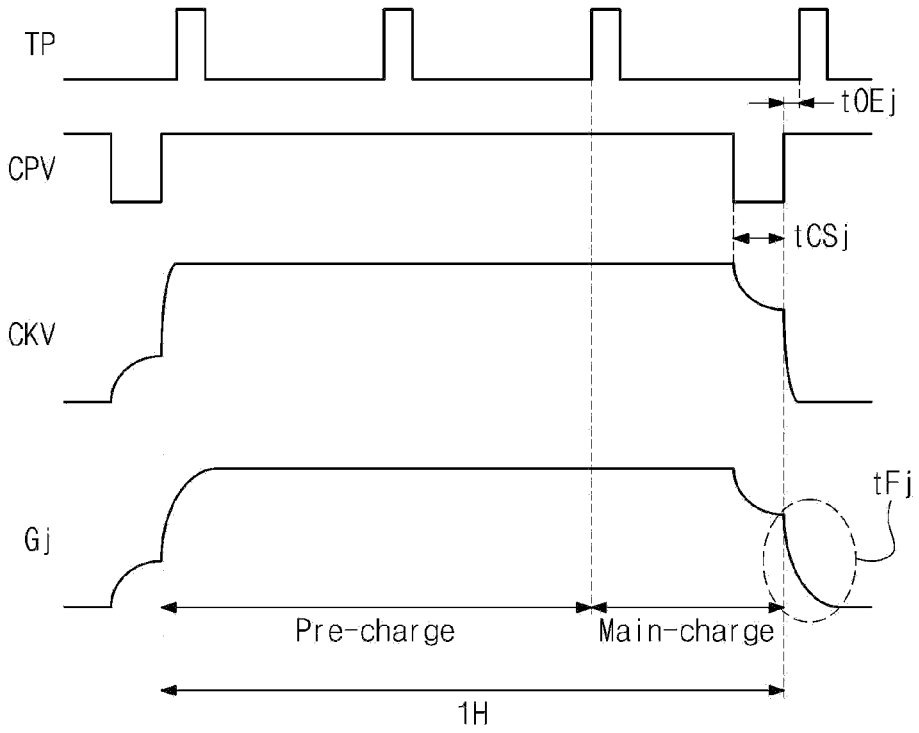
Figure 5:
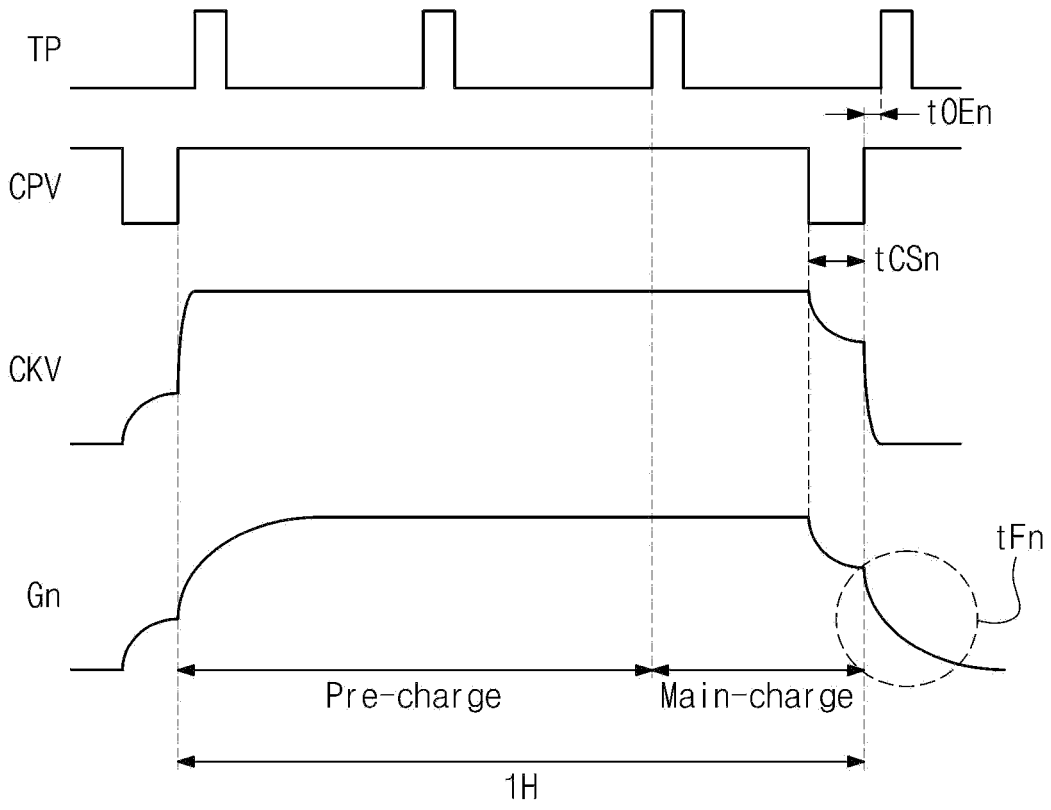

FIGS. 3, 4, and 5 illustrate falling time changes of the gate signals provided to the gate lines illustrated in FIG. 1.

Referring to FIGS. 1, 3, 4, and 5, the clock generator 130 generates and outputs the gate clock signal CKV in response to the gate pulse signal CPV from the timing controller 120. The first gate driver 150 and the second gate driver 160 output the gate signals G1 to Gn for driving the gate lines GL1 to GLn, in response to the start pulse signal STV and the gate clock signal CKV from the timing controller 120.

One period of a pulse of the gate clock signal CKV is referred to as '1 horizontal period (1H).' A gate line pre-charge driving scheme applies a gate-on voltage VON to one gate line during 1 horizontal period 1H of the gate line, and a first 2/3H of the gate line overlaps with a last 2/3H of an adjacent previous gate line. The gate line pre-charge driving scheme has an effect of compensating for a charging time of the liquid crystal capacitor, which is reduced due to an increase of the number of gate lines.

Pulses of the gate clock signal CKV respectively correspond to the gate lines GL1 to GLn of the display panel 110. When charge share periods tCS1 to tCSn of pulses corresponding to the gate lines GL1 to GLn of the display panel 110 are configured to be substantially identical (tCS1= . . . =tCSj= . . . =tCSn), the falling times tF1 to tFn of the gate signals G1 to Gn provided to the gate lines GL1 to GLn may be different dues to the resistance and capacitance components in the stages SCR1 to SCRn.

For example, the gate signal G1 provided to the gate line GL1 positioned at a top end of the display panel 110 has a shorter falling time than the gate signal Gj provided to the gate line GLj, and the gate signal Gj provided to the gate line GLj has a shorter falling time than the gate signal Gn provided to the gate line GLn (tF1<tFj<tFn). This discrepancy is caused by, as described above, the resistance and capacitance components in the stages SCR1 to SCRn).

As the falling times tF1 to tFn of the gate signals G1 to Gn become longer, coupling capacitance between a pixel and a gate line is reduced and a kickback voltage is reduced accordingly. For example, a kickback voltage Vk1 of the pixel PX11 is greater than a kickback voltage Vkj of the pixel PXj1, and the kickback voltage Vkj of the pixel PXj1 is greater than a kickback voltage Vkn of the pixel PXn1 (Vk1>Vkj>Vkn).

Figure 6:
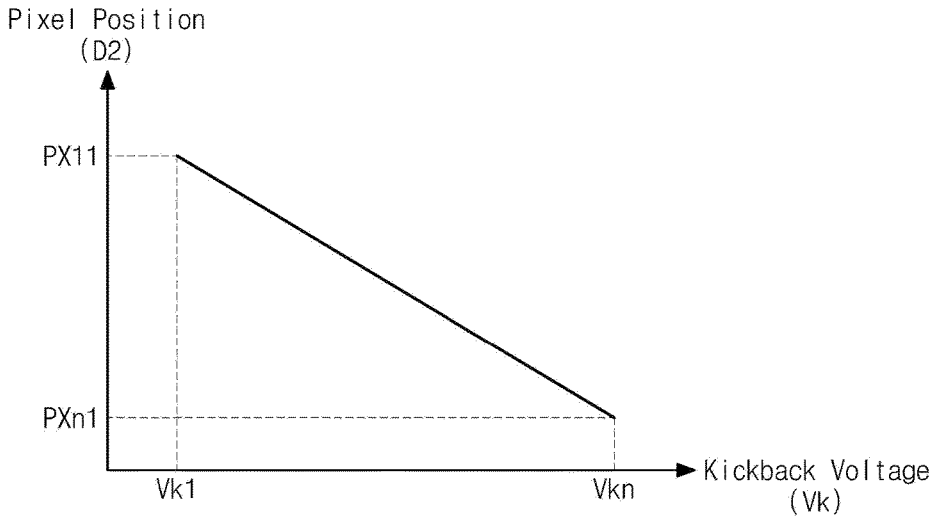
FIG. 6 illustrates an exemplary kickback voltage change according to a pixel position of the display panel illustrated in FIG. 1.

FIG. 6 illustrates an exemplary kickback voltage change according to a pixel position of the display panel.

Referring FIGS. 1 and 6, the kickback voltage Vk1 of the pixel PX11 positioned at the top end of the display panel 110 is greater than the kickback voltage Vkn of the pixel PXn1 positioned at bottom end of the display panel 110. A charge ratio of the liquid crystal capacitor in each pixel PX11 to PXnm may be determined differently according to the kickback voltage. When the pixels PX11 to PXnm of the display panel 110 have different kickback voltages, the quality of an image may become less uniform.

Figure 7:
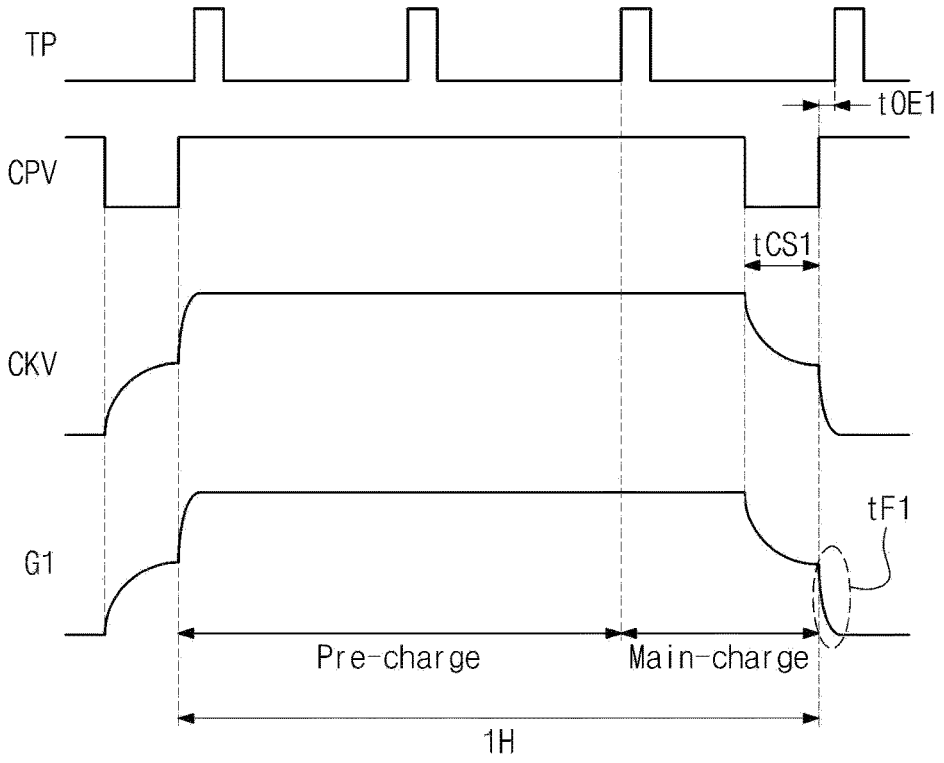
FIGS. 7, 8, and 9 illustrate falling time changes of gate signals provided to the gate lines illustrated in FIG. 1.
Figure 8:
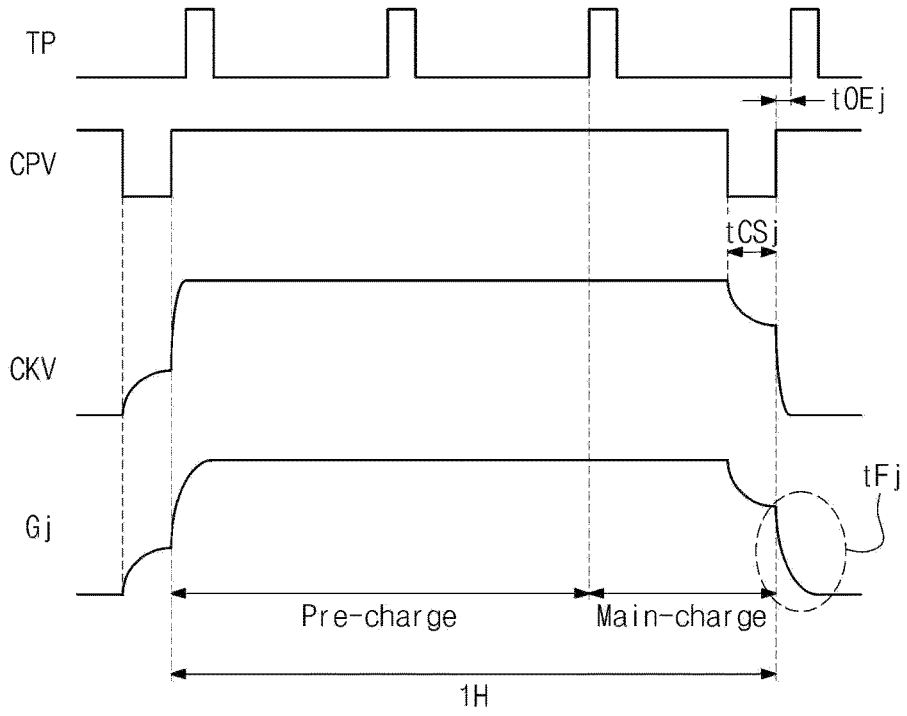
Figure 9:
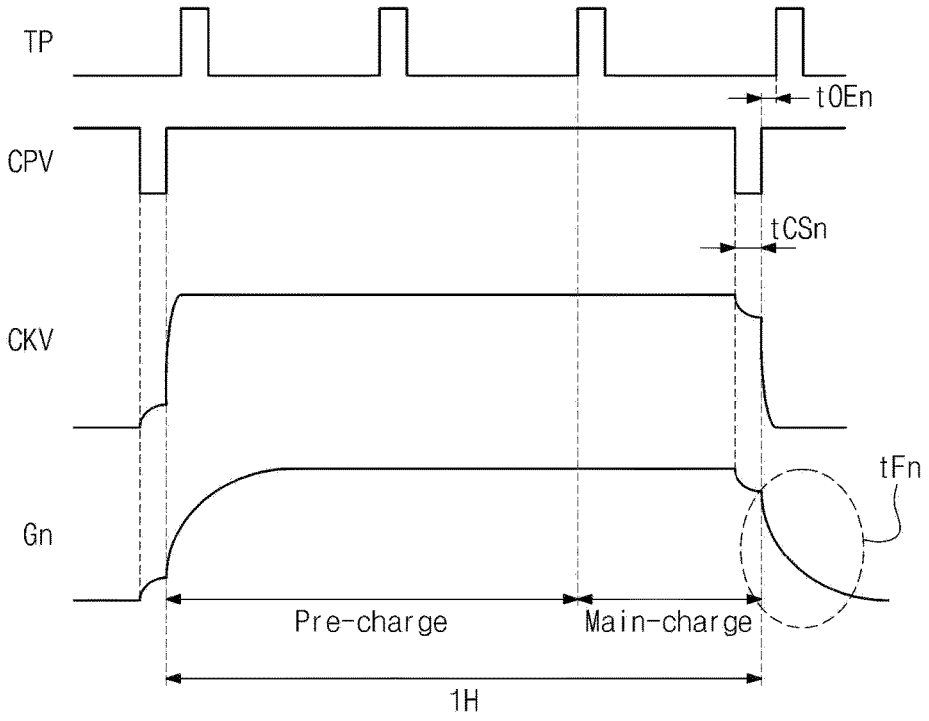

FIGS. 7, 8, and 9 illustrate falling time changes of gate signals provided to the gate lines illustrated in FIG. 1.

Referring to FIGS. 1, 7, 8, and 9, the timing controller 120 generates the gate pulse signal CPV. Pulses of the gate pulse signal CPV respectively correspond to the gate lines GL1 to GLn of the display panel 110. The timing controller 120 sets a charge share period of each pulse of the gate pulse signal CPV differently, according to positions of the gate lines GL1 to GLn. The clock generator 130 outputs the gate clock signal CKV in response to the gate pulse signal CPV from the timing controller 120.

The first and second gate drivers 150 and 160 output gate signal G1 to Gn for driving the gate lines GL1 to GLn, in response to the start pulse signal STV and the gate clock signal CKV from the timing controller 120.

For example, the charge share periods tCS1, tCSj, and tCSn of the pulses of the gate clock signal CKV corresponding to the gate lines GL1, GLj, and Gln are set differently from each other (tCS1>tCSj>tCSn). As described above, the decreased uniformity in kickback voltage may be compensated by providing different falling times tF1 to tFn of the gate signals G1 to Gn provided to the gate lines GL1 to GLn. For example, since the falling time tFj of the gate signal Gj provided to the gate line GLj is longer than the falling time tF1 of the gate signal G1 provided to the gate line GL1, the charge share period tCS1 of the gate signal G1 may be set to be longer than the charge share period tCSj of the gate signal Gj. The charge amount of the pixel PXj1 connected to the gate line GLj with a shorter charge share period may be greater than that of the pixel PX11 connected to the gate line GL1. Accordingly, the kickback voltage reduction, which occurs when the falling time tFj of the gate signal Gj provided to the gate line GLj is longer than the falling time tF1 of the gate signal G1, may be compensated by increasing the charge amount.

Similarly, since the falling time tFn of the gate signal Gn provided to the gate line GLn is longer than the falling time tFj of the gate signal Gj, the charge share period tCSj of the gate signal Gj may be set to be longer than the charge share period tCSn of the gate signal Gn. The charge amount of the pixel PXn1 connected to the gate line GLn with shorter charge share period may be greater than that of the pixel PXj1 connected to the gate line GLj. Accordingly, the kickback voltage reduction, which occurs when the falling time tFn of the gate signal Gn provided to the gate line GLn is longer than the falling time tFj of the gate signal Gj, may be compensated by increasing the charge amount.

According to exemplary embodiments of the present invention, the timing controller 120 may compensate the decreased uniformity in kickback voltages by providing different falling times tCS1 to tCSn of the gate signals G1 to Gn respectively provided to the gate lines GL1 to GLn, by adjusting a pulse width of the gate pulse signal CPV.

Figure 10:
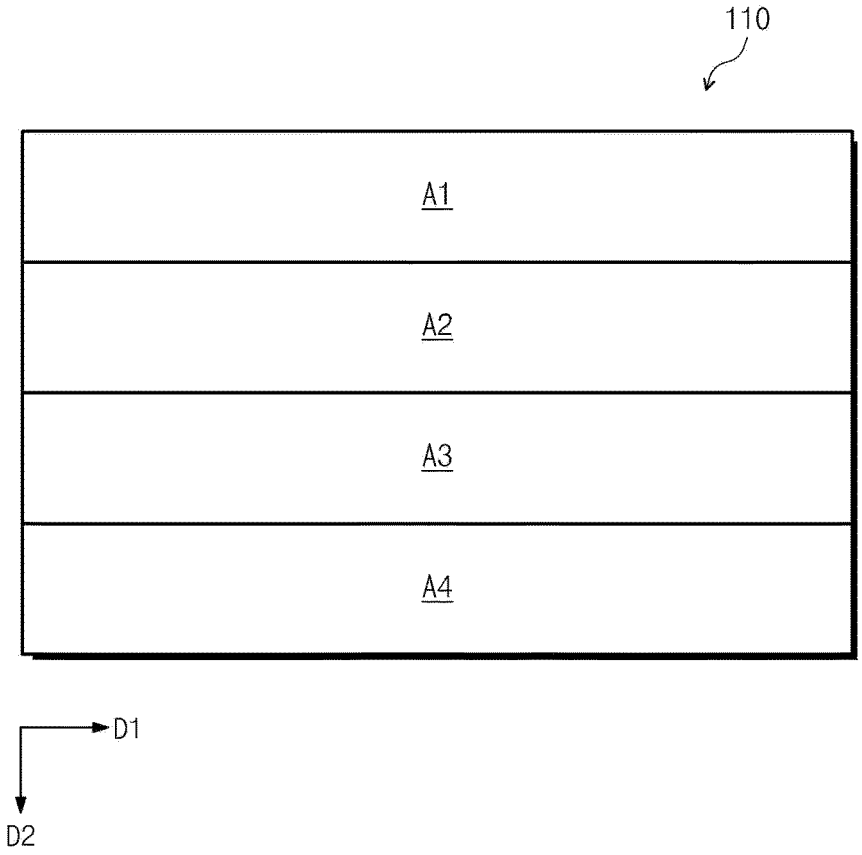
FIG. 10 illustrates an exemplary display panel illustrated in FIG. 1.
Figure 11:
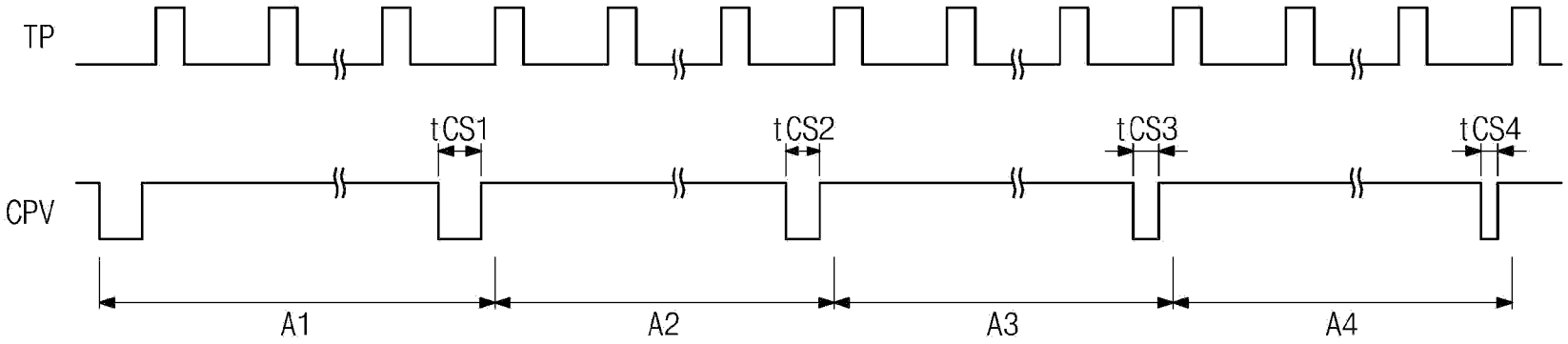
FIG. 11 is a timing diagram representing an exemplary gate pulse signal generated by the timing controller illustrated in FIG. 1.

FIG. 10 illustrates an exemplary display panel illustrated in FIG. 10. FIG. 11 is a timing diagram illustrating an exemplary gate pulse signal generated in the timing controller illustrated in FIG. 1.

Referring to FIGS. 1, 10, and 11, the display panel 110 may be divided into first to fourth display regions A1 to A4. The memory 170 may store charge share signals CS1 to CS4 respectively corresponding to the first to fourth display regions A1 to A4. The exemplary embodiment illustrated in FIG. 10 discloses that the display region is divided into 4 regions and memory 170 may correspondingly store 4 charge share signals. However, exemplary embodiment of present invention may be configured to have a different number of display regions and charge share signals stored in the memory 170.

The timing controller 120 adjusts a pulse width of the gate pulse signal CPV in response to externally provided control signals CTRL and the charge share signals CS1 to CS4 from the memory 170.

Pulses of the gate pulse signal CPV respectively correspond to the gate lines GL1 to GLn of the display panel 110. The timing controller 120 generates the gate pulse signal CPV, so that the pulses of the gate pulse signal CPV corresponding to the gate lines GL1 to GLa in the first display region A1 have the charge share period tCS1 corresponding to the charge share signal CS1. The timing controller 120 generates the gate pulse signal CPV corresponding to the gate lines GLa+1 to GLb in the second display region A2 to have the charge share period tCS2 corresponding to the charge share signal CS2. The timing controller 120 generates the gate pulse signal CPV corresponding to the gate lines GLb+1 to GLc in the third display region A3 to have the charge share period tCS3 corresponding to the charge share signal CS3. The timing controller 120 generates the gate pulse signal CPV corresponding to the gate lines GLc+1 to GLd in the first display region A4 to have the charge share period tCS4 corresponding to the charge share signal CS4. Here, a<b<c<n, where a, b, c, and n are positive integers. In addition, tCS1>tCS2>tCS3>tCS4.

Therefore, charge amounts of pixels positioned in the lower region in the second direction D2 of the display panel 110 are increased. Thus, the decrease in uniformity of image quality from coupling capacitance between the pixel and the gate line can be compensated.

A timing controller of a display apparatus according to exemplary embodiments of the inventive concept adjust a charge sharing period of a gate pulse signal according to charge sharing signals corresponding to kickback voltages of pixels. Accordingly, the kickback voltage of the pixel is compensated and display quality of an image can be improved.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. A display apparatus, comprising:

gate lines extending in a first direction;

data lines extending in a second direction intersecting the first direction;

pixels respectively connected to corresponding ones of the gate lines and the data lines;

a gate driver configured to drive the gate lines in response to a gate clock signal;

a data driver configured to drive the data lines;

a memory configured to store charge share signals;

a timing controller configured to control the data driver and the gate driver in response to an externally input control signal and an image signal and to generate a gate pulse signal comprising gate pulses; and a clock generator configured to generate the gate clock signal in response to the gate pulse signal received from the timing controller, wherein the display panel comprises display regions sequentially arrayed in the second direction, wherein each of the charge share signals corresponds to one of the display regions, wherein the timing controller is configured to adjust the pulse width of the gate pulse signal applied to the gate lines in each of the display regions, according to the charge share signals corresponding to each of the display regions, and wherein the charge share signals are configured to respectively correspond to charge share periods that are inversely proportional to distances in the second direction from the data driver to the corresponding display regions.

2. The display apparatus of claim 1, wherein the timing controller is configured to adjust the pulse width of the gate pulse signal corresponding to gate lines arrayed in a k-th (wherein k is a positive integer) display region in response to a k-th charge share signal of the charge share signals.

3. The display apparatus of claim 1, wherein the plurality of charge share signals are configured to respectively correspond to a charge share periods that are proportional to a kickback voltage in a pixel in a corresponding display region.

4. The display apparatus of claim 1, wherein the memory comprises an electrically erased programmable ROM (EEPROM).

5. The display apparatus of claim 1, wherein:

the gate driver is implemented as a circuit comprising either an amorphous silicon thin film transistor or an oxide semiconductor transistor; and the gate driver is disposed on one side of the display panel.

6. The display apparatus of claim 4, wherein the timing controller is further configured to generate a start pulse signal in response to the control signal.

7. The display apparatus of claim 5, wherein:

the gate driver comprises stages respectively corresponding to the gate lines; and each of the stages is configured to drive a corresponding gate line in response/to the gate clock signal and the start pulse signal.

* * * * *